United States Patent [19]

Syrjanen

[11] 4,072,274

[45] Feb. 7, 1978

[54] PROCEDURE AND APPARATUS FOR PREPARING HOT GROUNDWOOD

[75] Inventor: Ahti Syrjanen, Valkeakoski, Finland

[73] Assignee: Yhtyneet Paperitehtaat Osakeyhtio Jylhavaara, Valkeakoski, Finland

[21] Appl. No.: 766,776

[22] Filed: Feb. 8, 1977

[51] Int. Cl.[2] ..... B27L 11/08

[52] U.S. Cl. ..... 241/28; 241/29; 241/65

[58] Field of Search ..... 241/18, 28, 29, 65

[56] References Cited

U.S. PATENT DOCUMENTS

| | | | |
|---|---|---|---|
| 3,016,324 | 1/1962 | Textor | 241/28 |
| 3,411,720 | 11/1968 | Jones et al. | 241/28 |
| 3,661,328 | 5/1972 | Leask | 241/28 |
| 3,910,505 | 10/1975 | Reinhall | 241/28 |

*Primary Examiner*—Granville Y. Custer, Jr.
*Attorney, Agent, or Firm*—Haseltine, Lake & Waters

[57] ABSTRACT

Procedure for preparing hot groundwood from wood chips, wherein a chip stream is conducted into a pressurized steaming chamber, where the chips stay a few minutes and are heated to a temperature higher than 100° C, and from the steaming chamber through a sluice feeder into a hot grinder of enclosed construction, i.e. the stage I grinder, whence the pre-ground groundwood is conducted through a separating cyclone into a stage II grinder, the groundwood derived herefrom being conducted towards further treatment steps. The pre-ground groundwood is conducted from the steam separating cyclone through a sluice feeder into the stage II grinder. The stage II grinding is carried out in a hot grinder of enclosed construction.

5 Claims, 2 Drawing Figures

PROCEDURE AND APPARATUS FOR PREPARING HOT GROUNDWOOD

Figure 1:
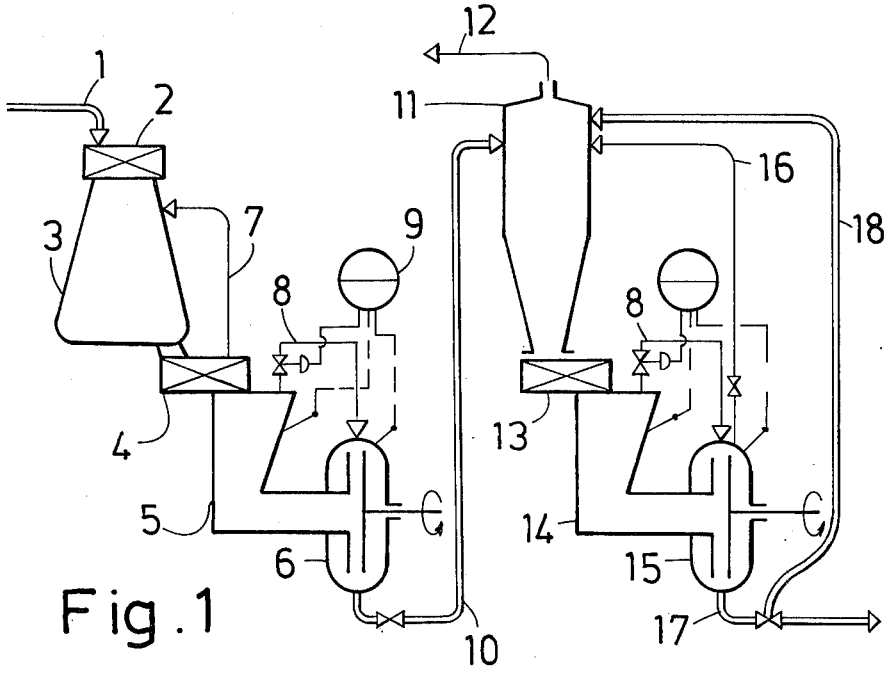

Hot groundwood is made conventionally from wood chips by a continuous process in principle in that the chips are first conducted into a steaming chamber, where they are heated to a temperature higher than 100° C, preferably between 120° and 135° C. From the steaming chamber the chip stream is conducted through a sluice feeder into a hot grinder, at which stage the dry matter content of the chips is about 20 to 30%. The hot groundwood obtained from the grinder is passed into a steam separating cyclone and thereafter usually further into a second grinder, which consists of a grinder of the open type and operating under atmospheric pressure and at ambient temperature.

A hot groundwood preparation procedure of this kind affords a number of advantages. The heating of the chips prior to grinding promotes the detachment of the fibers so that the energy required in the grinding process is reduced. Owing to the heating of the chips even such wood species can be processed, as pine and aspen for instance, which cannot othewise possibly be ground. Deciduous wood produced in short rotation cultivation is also appropriate to be used as raw material. The saving of grinding energy is about 20 to 30%. The strength characteristics of the groundwood improve. The procedure is favorable in view of environment protection since the use of water is minimal. The process is a so-called half-dry method.

The hot groundwood preparing methods of the existing art are however still encumbered by drawbacks. The energy requirements are high. Part of the energy is dissipated with the steam. It is also a drawback that wood slivers remain in the groundwood. If attempts are made to increase the degree of grinding, the proportion of the long fiber fraction decreases substantially. The invention has therefore as its object a procedure for preparing hot groundwood from wood chips in which procedure the chip stream is conducted into a pressurized steaming chamber, where the chips dwell a few minutes and are heated to a temperature higher than 100° C, and from the steaming chamber through the sluice feeder into a hot grinder of enclosed construction, or into the stage I grinder, whence the pre-ground groundwood is conducted through a steam separating cyclone into a stage II grinder, the groundwood obtained therefrom being carried towards further treatment steps. The procedure of the invention is characterized in that the pre-ground groundwood is conducted from the steam separating cyclone through a sluice feeder into the stage II grinder and that the stage II grinding is carried out in a hot grinder of enclosed construction.

In the procedure of the invention the energy requirement of the stage II grinding is reduced because the grinding takes place under hot conditions and the wood splinters therefore are softer. Since the stage II grinding is effected in a hot grinder, the quality of the resulting groundwood improves. For instance, the long fiber fraction is retained because the grinding is not violent.

An advantageous embodiment of the invention is characterized in that the steam generated by the stage II grinder is conducted into a steam separating cyclone. It is thus understood that all the excess steam both from the stage I grinder and from the stage II grinder is collected at one point, whence the energy contained in the steam can be drawn for use in a controlled manner at other consumption points, such as the prewashing of the wood chips, for instance. A favorable energy efficiency is thus attained. Energy is only introduced into the process as rotational energy for the grinders, and it is removed from the process in the form of steam energy only. Thus, the energy introduced into the process is also used, in addition to the grinding, for chip washing, chip heating and the transporting of chips or groundwood within the process. The transport is by the aid of pressure through pipelines. No separate screw conveyors or equivalent are needed. Recovery of solid residues from the steam of the steam separating cyclone is possible, and therefore the process also meets high requirements as regards environment protection.

Another advantageous embodiment of the invention is characterized in that part of the groundwood produced by the stage II grinder is conducted back to the steam separating cyclone. From here the groundwood passes once more into the stage II grinder. In this manner the stage II grinder will always operate under full load. No equivalent recycling is applied in the stage I grinding because the material would be highly non-homogeneous and because it is possible to adapt the stage I grinder for the process in such manner that it will always operate under optimum load.

The invention also concerns an apparatus for carrying out the method, comprising a steaming chamber, a sluice feeder, a hot grinder of enclosed construction, i.e. the stage I grinder, a steam separating cyclone, and a stage II grinder, the chip stream passing consecutively through these and being ground into groundwood. The apparatus is characterized in that between the steam separating cyclone and the stage II grinder there is a sluice feeder, and that the stage II grinder consists of a hot grinder of enclosed construction.

The invention is described in the following with the aid of an example and with reference to the attached drawing, wherein:

FIG. 1 presents the equipment associated with the groundwood preparation process.

Figure 2:
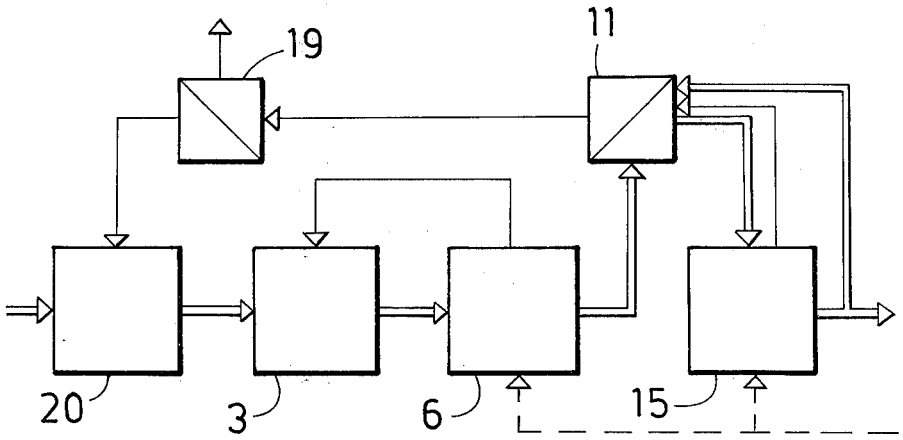

FIG. 2 is a block diagram illustrating the preparation process.

In FIG. 1, prewashed wood chips are supplied in a continuous stream through the pipeline 1 into the sluice feeder 2 and thence further into the steaming chamber 3. In this prevails a pressure of about 2 kg/cm$^2$ gauge, the temperature being between 120° and 135° C. The dry matter content of the chips is about 20%. From the steaming chamber 3 the chip stream is conducted through the sluice feeder 4 by the duct 5 into the hot grinder 6 of enclosed construction, which serves as the stage I grinder. The stage I grinder 6 generates steam, the main part thereof discharging in the direction against the chip stream into the duct 5. Part of the steam passes through the sluice feeder 4 by the conduit 7 into the steaming chamber 3. The quantity of steam arriving here is so regulated that the chips will attain the temperature mentioned above, within 2 to 4 minutes, which is the time which the chips stay in the steaming chamber 3. Part of the steam entering the duct 5 is conducted back to the stage I grinder 6 to the outer circumference thereof, through the conduit 8. In the duct 5 and on the outer periphery of the stage I grinder 6 pressure transmitters have been provided, which transmit information to the pressure controller 9, which in its turn controls the quantity of steam flowing in the line 8. Part of the steam generated by the stage I grinder 6 escapes by the pipeline 10 along with the groundwood to the steam separating cyclone 11. Hence, the steam escapes into the pipeline 12, and the groundwood settles downwardly.

From the lower end of the steam separating cyclone 11 the groundwood goes through the sluice feeder 13 by the duct 14 to the hot grinder 15 of enclosed design, which operates as stage II grinder. The stage II grinder 15 with its associated apparatus is identical in principle with the stage I grinder 6. It has as additional equipment the pipeline 16, which starts on the outer periphery of the stage II grinder 15 and terminates at the steam separating cyclone 11 and which conducts off any excess steam. It is thus understood that the excess steam will all be collected in the steam separating cyclone 11. The hot groundwood leaves the stage II grinder 15, pushed by steam pressure, through the pipeline 17, towards further treatment steps. With this line 17 a branch line 18 is connected, through which part of the hot groundwood is supplied back to the steam separating cyclone 11, whence the groundwood has to pass once more through the stage II grinder 15. As a result, the stage II grinder 15 will continuously operate under full load.

In FIG. 2 the process has been shown in the form of a block diagram. Here one can see, as in FIG. 1, the steaming chamber 3, the stage I grinder 6, the steam separating cyclone 11 and the stage II grinder 15. Furthermore the condensate separator 19 has been shown, the condensate accruing therefrom being used in the washer 20 to wash the wood chips. The chip flow and the groundwood flow have been represented with double lines, the steam flow with single lines, and the energy flow required for rotation of the grinders 6 and 15 with interrupted lines.

It is obvious to one skilled in the art that difference embodiments of the invention may vary within the scope of the claims presented below. This concerns, e.g., the design and construction of the various pieces of equipment, such as the sluice feeders and the grinders.

I claim:

1. In a process for preparing hot groundwood from wood chips, wherein a chip stream is conducted into a pressurized steaming chamber, where the chips stay a few minutes and are heated to a temperature higher than 100° C, and from the steaming chamber is conducted through a sluice feeder into a hot stage I grinder of enclosed construction, whence the pre-ground groundwood is conducted through a separating cyclone into a stage II grinder, and the groundwood from the stage II grinder is conducted towards further treatment steps, the improvement which comprises the step of conducting the pre-ground groundwood from the steam separating cyclone through a sluice feeder into a hot stage II grinder of enclosed construction and conducting steam generated by the stage II grinder into the steam separating cyclone.

2. The process of claim 1 wherein part of the groundwood produced by the stage II grinder is reconducted to the steam separating cyclone.

3. In an apparatus for preparing a hot groundwood from wood chips comprising a steaming chamber, a sluice feeder, a hot stage I grinder of enclosed construction, a steam separating cyclone, a stage II grinder and a hot groundwood output line leading from the stage II grinder, connected so that a chip stream passes consecutively therethrough, the improvement comprising a sluice feeder located between the steam separating cyclone and the stage II grinder; a hot stage II grinder of enclosed construction and a steam pipeline connecting the stage II grinder to the steam separator.

4. The apparatus of claim 3, further comprising a branch line connecting the stage II hot grinder output line to the steam separating cyclone.

5. The apparatus of claim 3, further comprising an external, steam pipeline connecting the input side and output side of the stage II grinder with each other for the purpose of controlling the pressure difference between them and a second external steam pipeline connecting the input side and output side of the stage I grinder to each other for the purpose of controlling the pressure difference between them.

* * * * *